US011145474B1

(12) United States Patent
Pan et al.

(10) Patent No.: US 11,145,474 B1
(45) Date of Patent: Oct. 12, 2021

(54) KEYBOARD DEVICE AND KEY STRUCTURE THEREOF

(71) Applicant: Primax Electronics Ltd., Taipei (TW)

(72) Inventors: Chin-Sung Pan, Taipei (TW); Chien-Hung Liu, Taipei (TW); Lei-Lung Tsai, Taipei (TW); Sheng-Fan Chang, Taipei (TW); Tsu-Yi Chen, Taipei (TW); Chun-Yuan Liu, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/004,828

(22) Filed: Aug. 27, 2020

(30) Foreign Application Priority Data

Jul. 10, 2020 (TW) ..... 109123448

(51) Int. Cl.
*H01H 13/14* (2006.01)
*H01H 13/70* (2006.01)
*H01H 13/10* (2006.01)

(52) U.S. Cl.
CPC ..... *H01H 13/70* (2013.01); *H01H 13/10* (2013.01); *H01H 13/14* (2013.01); *H01H 2233/07* (2013.01)

(58) Field of Classification Search
CPC ..... H01H 9/26; H01H 13/72; H01H 25/00; H01H 25/04; H01H 1/02; H01H 3/125; H01H 13/83; H01H 13/705; H01H 13/14; H01H 13/70; H01H 2221/062; H01H 2221/026
See application file for complete search history.

(56) References Cited

U.S. PATENT DOCUMENTS

2003/0169232 A1* 9/2003 Ito ..... H01H 9/047 345/156
2020/0273642 A1* 8/2020 Yen ..... G06F 3/03543

* cited by examiner

*Primary Examiner* — Ahmed M Saeed
(74) *Attorney, Agent, or Firm* — Kirton McConkie; Evan R. Witt

(57) ABSTRACT

A keyboard device includes plural key structures. Each key structure includes a supporting plate, a keycap, a connecting member and a hook element. The keycap is located over the supporting plate, and movable upwardly or downwardly relative to the supporting plate. The connecting member is connected between the supporting plate and the keycap. The hook element is installed on the supporting plate. The connecting member is connected with the supporting plate through the hook element. The supporting plate is made of a first material with a first specific gravity. The hook element is made of a second material with a second specific gravity. The second specific gravity is higher than the first specific gravity.

15 Claims, 6 Drawing Sheets

KEYBOARD DEVICE AND KEY STRUCTURE THEREOF

FIELD OF THE INVENTION

The present invention relates to an input device, and more particularly to a keyboard device and a key structure thereof.

BACKGROUND OF THE INVENTION

With increasing development of science and technology, a variety of electronic devices are designed in views of convenience and user-friendliness. For helping the user well operate the electronic devices, the electronic devices are gradually developed in views of humanization. The input devices of the common electronic devices include for example mouse devices, keyboard devices, trackball devices, or the like. Via the keyboard device, characters or symbols can be inputted into the computer system directly. As a consequence, most users and most manufacturers of input devices pay much attention to the development of keyboard devices.

Generally, a keyboard device comprises plural key structures. Each key structure comprises a keycap, a scissors-type connecting member, a membrane circuit board and a supporting plate. These components are stacked on each other sequentially. In case that the keyboard device is a luminous keyboard device, the keyboard device is equipped with a backlight module under the supporting plate.

Moreover, a membrane switch is installed on the membrane circuit board, and an elastic element is arranged between the keycap and the membrane circuit board. The scissors-type connecting member is connected between the keycap and the supporting plate. Moreover, the scissors-type connecting member comprises a first frame and a second frame. The second frame is pivotally coupled to the first frame. Consequently, the first frame and the second frame can be swung relative to each other. While the keycap of any key structure is depressed and moved downwardly relative to the supporting plate, the first frame and the second frame of the scissors-type connecting member are switched from an open-scissors state to a stacked state. Moreover, as the keycap is moved downwardly to compress the elastic element, the corresponding membrane switch is pushed and triggered by the elastic element. Consequently, the keyboard device generates a corresponding key signal.

For providing the sufficient structural strength of the overall keyboard device, a metal with a higher strength is usually used as the material of the supporting plate. However, since the metallic material with the higher strength usually has a higher specific gravity, the overall weight of the keyboard device is largely increased. For effectively reducing the overall weight of the keyboard device, the supporting plate is made of a material with a lower specific gravity. For example, the supporting plate is made of a metallic material or a plastic material with a lower strength. However, the supporting plate is too brittle and easily broken. For example, the supporting plate has hook elements to be connected with the scissors-type connecting member. If the supporting plate is made of a metallic material or a plastic material with a lower strength, the hook elements are readily broken while the scissors-type connecting member is assembled with the supporting plate. Alternatively, plural hollow regions are formed in the supporting plate to reduce the weight of the supporting plate. Since the number of hollow regions is limited, the weight reduction is not obvious.

Therefore, it is important to provide an improved keyboard device and an improved key structure in order to overcome the drawbacks of the conventional technologies.

SUMMARY OF THE INVENTION

An object of the present invention provides a keyboard device. The key structure of the keyboard device includes a supporting plate and a hook element. The supporting plate and the hook element are made of different materials. The supporting plate is made of a first material with a lower specific gravity. The hook element is made of a second material with a higher specific gravity. Consequently, the overall weight is reduced, and the structural strength is increased.

Another object of the present invention provides a key structure. A supporting plate and a hook element of the key structure are made of different materials. The supporting plate is made of a first material with a lower specific gravity. The hook element is made of a second material with a higher specific gravity. Consequently, the overall weight is reduced, and the structural strength is increased.

The other objects and advantages of the present invention will be understood from the disclosed technical features.

In accordance with an aspect of the present invention, a keyboard device is provided. The keyboard device includes plural key structures. Each key structure includes a supporting plate, a keycap, a connecting member and a hook element. The keycap is located over the supporting plate, and movable upwardly or downwardly relative to the supporting plate. The connecting member is connected between the supporting plate and the keycap. The hook element is installed on the supporting plate. The connecting member is connected with the supporting plate through the hook element. The supporting plate is made of a first material with a first specific gravity. The hook element is made of a second material with a second specific gravity. The second specific gravity is higher than the first specific gravity.

In an embodiment, the first specific gravity of the first material is in a range between 1.4 g/cm$^3$ and 1.9 g/cm$^3$.

In an embodiment, the second specific gravity of the second material is in a range between 2.64 g/cm$^3$ and 7.93 g/cm$^3$.

In an embodiment, the first material is CEM-1 single-sided glass fiber material, CEM-3 double-sided half glass fiber material, FR4 double-sided glass fiber material, magnesium lithium alloy or magnesium alloy material.

In an embodiment, the second material is hot-dip galvanized steel material, aluminum alloy material or stainless steel material.

In an embodiment, each key structure further includes a membrane circuit board and an elastic element. The membrane circuit board is arranged between the keycap and the supporting plate. The elastic element is arranged between the membrane circuit board and the keycap.

In an embodiment, each key structure further includes a backlight module. The backlight module is located under the supporting plate. The supporting plate is arranged between the membrane circuit board and the backlight module.

In an embodiment, the connecting member is a scissors-type connecting member, a stabilizer bar or a combination of the scissors-type connecting member and the stabilizer bar.

In an embodiment, the supporting plate includes a top surface, a bottom surface and a perforation. The top surface and the bottom surface are opposed to each other. the perforation runs through the top surface and the bottom surface. The hook element includes a positioning part. The positioning part is penetrated through the perforation of the supporting plate. Consequently, the hook element is positioned on the supporting plate. A portion of the positioning part is protruded outside the perforation.

In an embodiment, each key structure further includes a fixing structure. A portion of the bottom surface of the supporting plate is covered by the fixing structure. The portion of the positioning part protruded outside the perforation is covered by the fixing structure. Consequently, the hook element is fixed on the supporting plate through the fixing structure.

In accordance with an aspect of the present invention, a key structure is provided. The key structure includes a supporting plate, a keycap, a connecting member and a hook element. The keycap is located over the supporting plate, and movable upwardly or downwardly relative to the supporting plate. The connecting member is connected between the supporting plate and the keycap. The hook element is installed on the supporting plate. The connecting member is connected with the supporting plate through the hook element. The supporting plate is made of a first material with a first specific gravity. The hook element is made of a second material with a second specific gravity. The second specific gravity is higher than the first specific gravity.

From the above descriptions, the present invention provides the keyboard device and the key structure. In the key structure, the supporting plate is made of a first material, and the hook element installed on the supporting plate is made of a second material. The first material has a first specific gravity. The second material has a second specific gravity. The second specific gravity of the second material is higher than the first specific gravity of the first material. Since the supporting plate is made of the material with the lower specific gravity, the overall weight of the keyboard device is largely reduced, and the weight reduction purpose is achieved. Moreover, since the hook element installed on the supporting plate is made of the material with the higher specific gravity, the structural strength of the hook element is largely increased. While the connecting member (e.g., the scissors-type connecting member) is assembled with the supporting plate through the hook element, the possibility of causing damage of the hook element can be effectively avoided.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
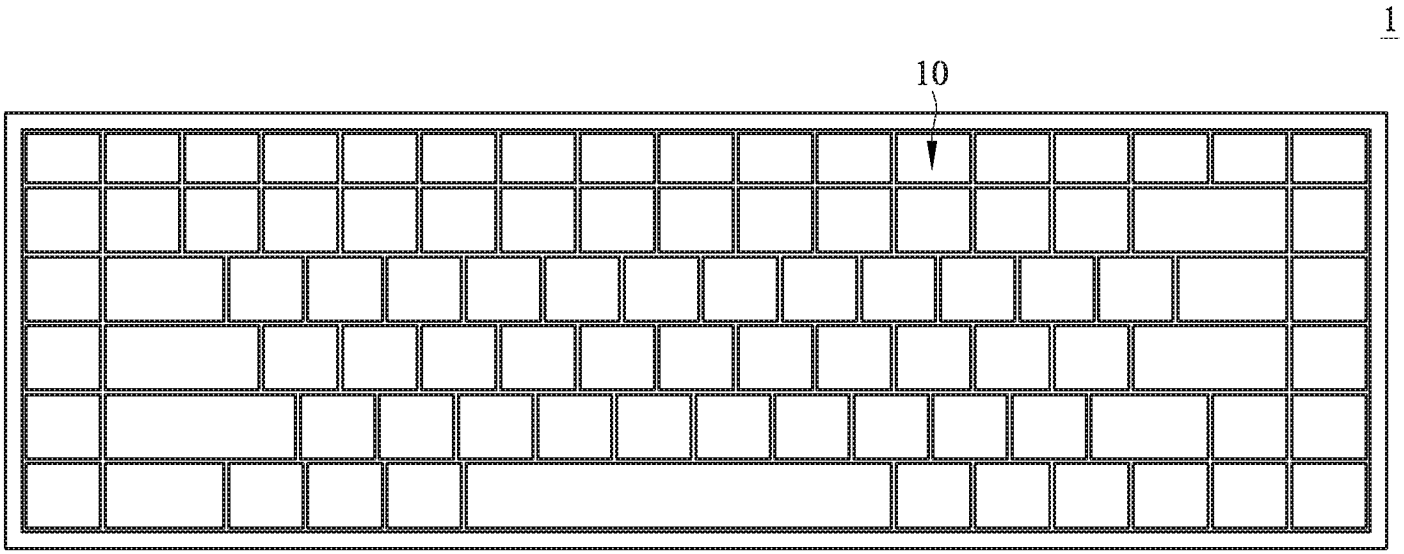
FIG. 1 is a schematic top view illustrating the outer appearance of a keyboard device according to an embodiment of the present invention.
Figure 2:
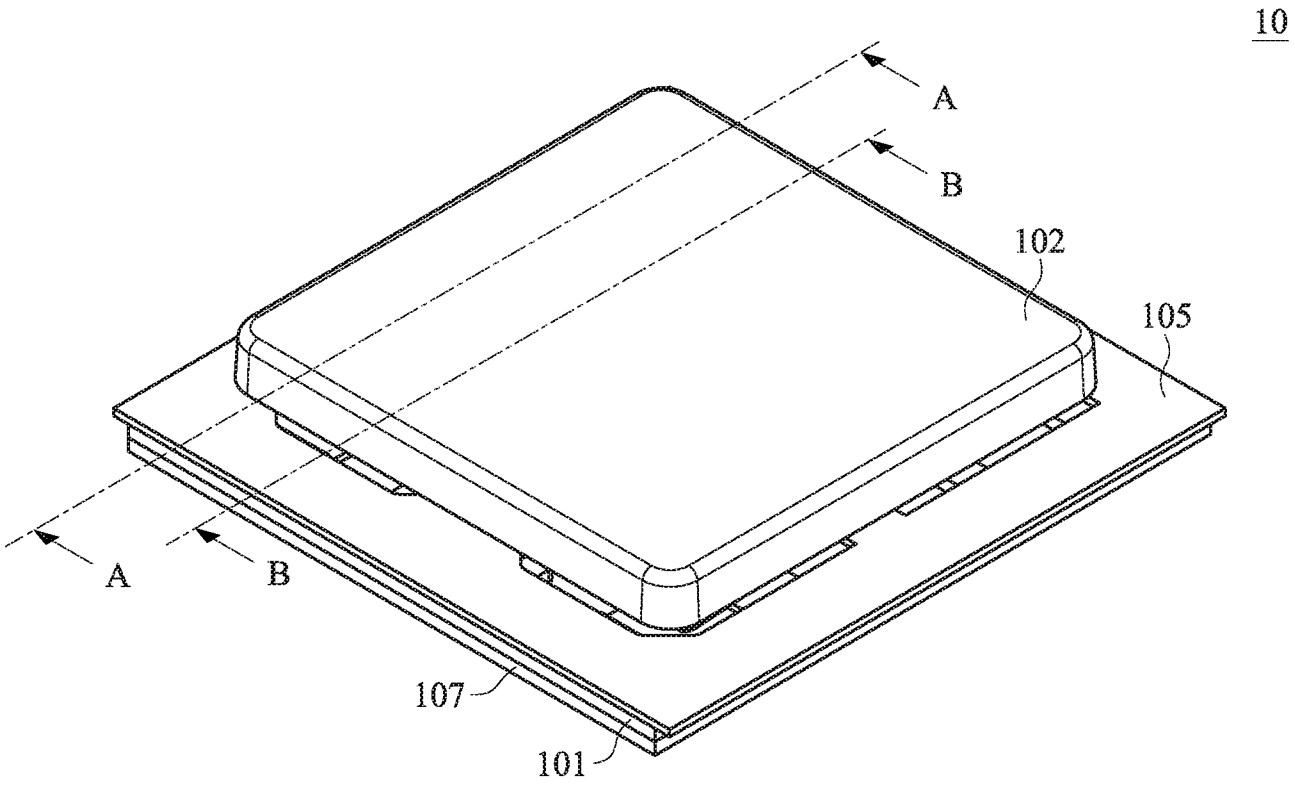
FIG. 2 is a schematic perspective view illustrating a key structure of the keyboard device as shown in FIG. 1.
Figure 3:
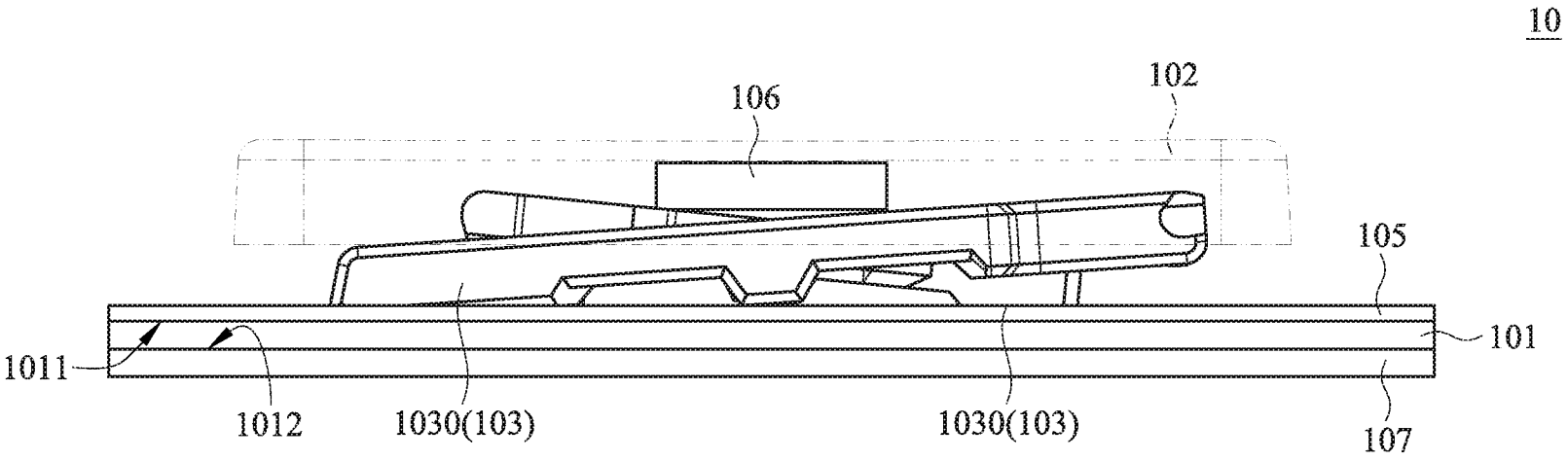
FIG. 3 is a schematic side view illustrating the key structure as shown in FIG. 2.
Figure 4:
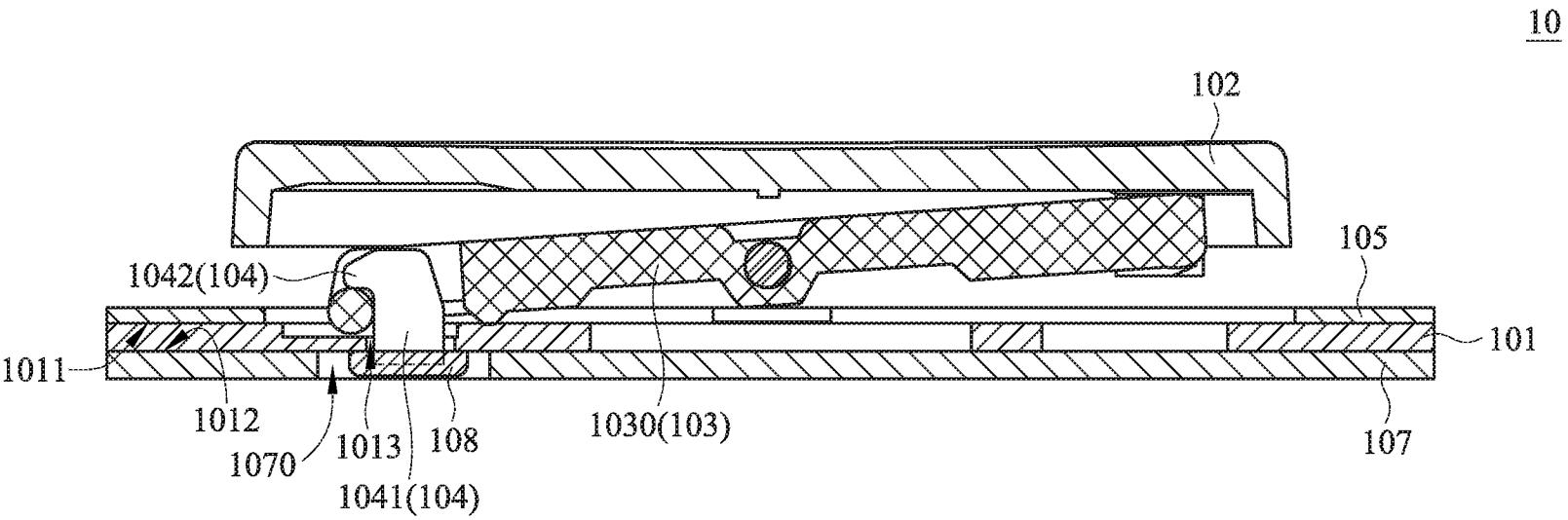
FIG. 4 is a schematic cross-sectional view illustrating the key structure as shown in FIG. 2 and taken along the line AA.
Figure 5:
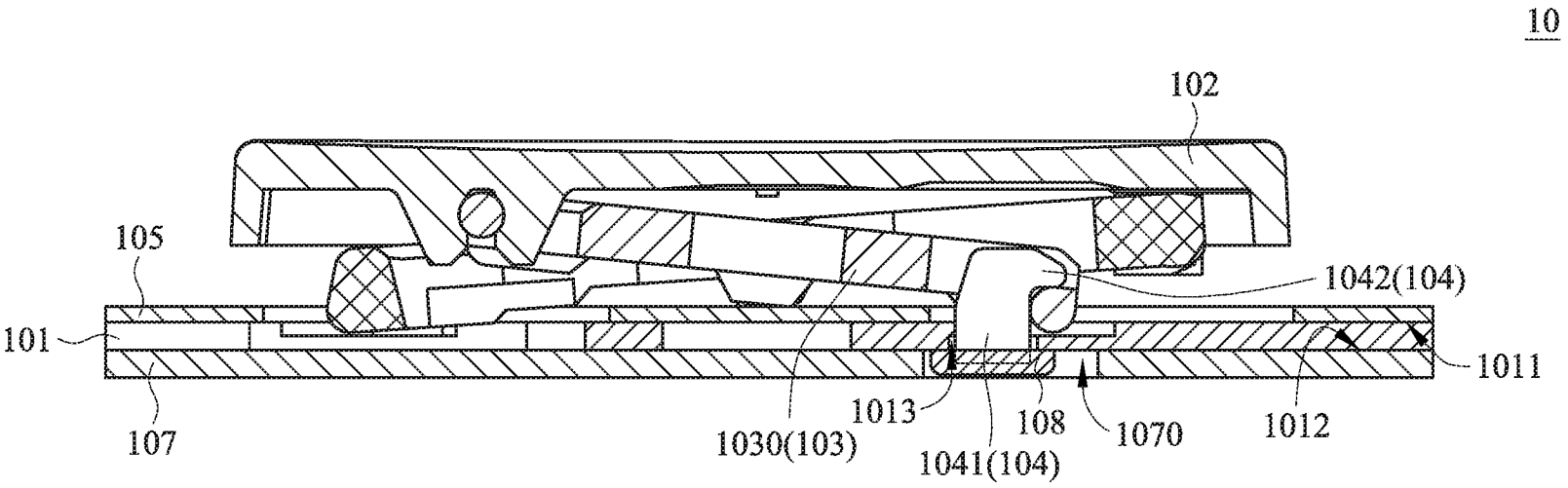
FIG. 5 is a schematic cross-sectional view illustrating the key structure as shown in FIG. 2 and taken along the line BB.

Please refer to FIGS. 1, 2, 3, 4 and 5. FIG. 1 is a schematic top view illustrating the outer appearance of a keyboard device according to an embodiment of the present invention. FIG. 2 is a schematic perspective view illustrating a key structure of the keyboard device as shown in FIG. 1. FIG. 3 is a schematic side view illustrating the key structure as shown in FIG. 2. FIG. 4 is a schematic cross-sectional view illustrating the key structure as shown in FIG. 2 and taken along the line AA. FIG. 5 is a schematic cross-sectional view illustrating the key structure as shown in FIG. 2 and taken along the line BB. For succinctness, only a single key structure and associated components are shown in FIGS. 2, 3, 4 and 5.

As shown in FIG. 1, the keyboard device 1 comprises plural key structures 10. These key structures 10 are classified into some types, e.g., ordinary keys, numeric keys and function keys. When one of the key structures 10 is depressed by the user's finger, the keyboard device 2A generates a corresponding key signal to a computer, and thus the computer executes a corresponding function. For example, when an ordinary key is depressed, a corresponding English letter or symbol is inputted into the computer. When a numeric key is depressed, a corresponding number is inputted into the computer. In addition, the function keys (F1~F12) can be programmed to provide various quick access functions.

The key structure 10 of the keyboard device 1 will be described in more details as follows.

Please refer to FIGS. 2, 3, 4 and 5 again. The key structure 10 comprises a supporting plate 101, a keycap 102, a connecting member 103 and at least one hook element 104. The keycap 102 is located over the supporting plate 101. Moreover, the keycap 102 is movable upwardly or downwardly relative to the supporting plate 101. The connecting member 103 is connected between the supporting plate 101 and the keycap 102. In an embodiment, the connecting member 103 is a scissors-type connecting member. It is noted that the example of the connecting member 103 is not restricted. The hook element 104 is installed on the supporting plate 101. The connecting member 103 is connected with the supporting plate 101 through the hook element 104.

In an embodiment, the supporting plate 101 is made of a first material, and the hook element 104 is made of a second material. The first material has a first specific gravity. The second material has a second specific gravity. The second specific gravity of the second material is higher than the first specific gravity of the first material. That is, the supporting plate 101 is made of the material with the lower specific gravity, and the hook element 104 is made of the material with the higher specific gravity. Consequently, the weight of the key structure 10 is reduced. Moreover, while the connecting member 103 is assembled with the supporting plate 101 through the hook element 104, the possibility of causing damage of the hook element 104 is avoided because the hook element 104 has the higher structural strength.

In an embodiment, the first specific gravity of the first material of the supporting plate 101 is in the range between 1.4 g/cm$^3$ and 1.9 g/cm$^3$. For example, the first material of the supporting plate 101 is CEM-1 single-sided glass fiber material, CEM-3 double-sided half glass fiber material or FR4 double-sided glass fiber material, which has the specific gravity in the range between 1.7 g/cm$^3$ and 1.9 g/cm$^3$. Alternatively, the first material of the supporting plate 101 is magnesium alloy material, which has a specific gravity of 1.8 g/cm$^3$. Alternatively, the first material of the supporting plate 101 is magnesium lithium alloy, which has a specific gravity of 1.6 g/cm$^3$. The example of the first material of the supporting plate 101 is not restricted as long as the specific gravity of the first material is lower than the specific gravity of the second material.

In an embodiment, the second specific gravity of the second material of the hook element 104 is in the range between 2.64 g/cm$^3$ and 7.93 g/cm$^3$. For example, the second material of the hook element 104 is GM55 aluminum alloy material with the specific gravity of 2.64 g/cm$^3$, AL5052 aluminum alloy material with the specific gravity of 2.7 g/cm$^3$, KU400 hot-dip galvanized steel material with the specific gravity of 7.85 g/cm$^3$ or SUS304 stainless steel material with the specific gravity of 7.93 g/cm$^3$. The example of the second material of the hook element 104 is not restricted as long as the specific gravity of the second material is higher than the specific gravity of the first material.

The material of the supporting plate 101 (i.e., the first material) and the material of the hook element 104 (i.e., the second material) may be selected according to the practical requirements. For example, in an embodiment, the first material of the supporting plate 101 is CEM-1 single-sided glass fiber material is CEM-1 single-sided glass fiber material with the specific gravity of 1.7 g/cm$^3$, and the second material of the hook element 104 is SUS304 stainless steel material with the specific gravity of 7.93 g/cm$^3$. Consequently, the overall weight of the key structure is reduced, and the structural strength is strong enough.

Please refer to FIGS. 2, 3, 4 and 5 again. The key structure 10 further comprises a membrane circuit board 105, an elastic element 106 and a backlight module 107. The membrane circuit board 105 is arranged between the keycap 102 and the supporting plate 101. Since the membrane circuit board 105 is made of a soft material and the membrane circuit board 105 is slim, the membrane circuit board 105 is supported by the underlying supporting plate 101. The elastic element 106 is arranged between the membrane circuit board 105 and the keycap 102. That is, the elastic element 106 is installed on the membrane circuit board 105.

While the keycap of any key structure 10 is depressed by the user and moved downwardly relative to the supporting plate 101, the connecting member 103 switched from an open-scissors state to a stacked state. Moreover, as the keycap 102 is moved downwardly to compress the elastic element 106, a membrane switch (not shown) on the membrane circuit board 105 is pushed and triggered by the elastic element 106. Consequently, the keyboard device 1 generates a corresponding key signal. The backlight module 107 is located under the supporting plate 101. Moreover, the supporting plate 101 is arranged between the backlight module 107 and the membrane circuit board 105. Preferably but not exclusively, the backlight module 107 comprises a light guide plate and a light-emitting element beside the light guide plate.

As mentioned above, the supporting plate 101 is made of the material with the lower specific gravity, and the hook element 104 is made of the material with the higher specific gravity. This design can be applied to the luminous keyboard device with the backlight module 107. Alternatively, this design can be applied to the keyboard device without the backlight module.

Please refer to FIGS. 4 and 5 again. The supporting plate 101 has a top surface 1011 and a bottom surface 1012, which are opposed to each other. The supporting plate 101 further comprises a perforation 1013. The perforation 1013 runs through the top surface 1011 and the bottom surface 1012. The hook element 104 comprises a positioning part 1041 and a hooking part 1042. The positioning part 1041 is penetrated through the perforation 1013 of the supporting plate 101. Consequently, the hook element 104 is positioned on the supporting plate 101. Moreover, when the positioning part 1041 of the hook element 104 is penetrated through the perforation 1013 of the supporting plate 101, a portion of the positioning part 1041 is protruded outside the perforation 1013. When two connecting frames 1030 of the connecting member 103 are pivotally coupled to the hooking parts 1042 of the corresponding hook elements 104, the connecting member 103 can be switched between the open-scissors state and the stacked state in response to the upward or downward movement of the keycap 102.

In the conventional key structure, the hook element is protruded from the supporting plate according to a stamping process. That is, the hook element is integrally formed with the supporting plate. In this embodiment, the hook element 104 and the supporting plate 101 are individual components. After the positioning part 1041 of the hook element 104 is penetrated through the perforation 1013 of the supporting plate 101, the hook element 104 is positioned on the supporting plate 101.

Please refer to FIGS. 4 and 5 again. The key structure 10 further comprises a fixing structure 108. A portion of the bottom surface 1012 of the supporting plate 101 is covered by the fixing structure 108. In addition, the portion of the positioning part 1041 protruded outside the perforation 1013 is covered by the fixing structure 108. Consequently, the hook element 104 is fixed on the supporting plate 101 through the fixing structure 108. In this embodiment, the backlight module 107 further comprises an opening 1070. When the fixing structure 108 covers the portion of the bottom surface 1012 of the supporting plate 101, the fixing structure 108 is accommodated within the opening 1070 of the backlight module 107. Preferably but not exclusively, the fixing structure 108 is a soldering material. That is, the hook element 104 is fixed on the supporting plate 101 through a soldering means. It is noted that the way of fixing the hook element 104 on the supporting plate 101 is not restricted to the soldering means. In another embodiment, the hook element 104 is fixed on the supporting plate 101 according to a surface mount technology, wherein no perforation is formed in the supporting plate 101. Alternatively, the hook element 104 is fixed on the supporting plate 101 through a riveting means. The way of fixing the hook element 104 on the supporting plate 101 may be modified according to the practical requirements.

Figure 6:
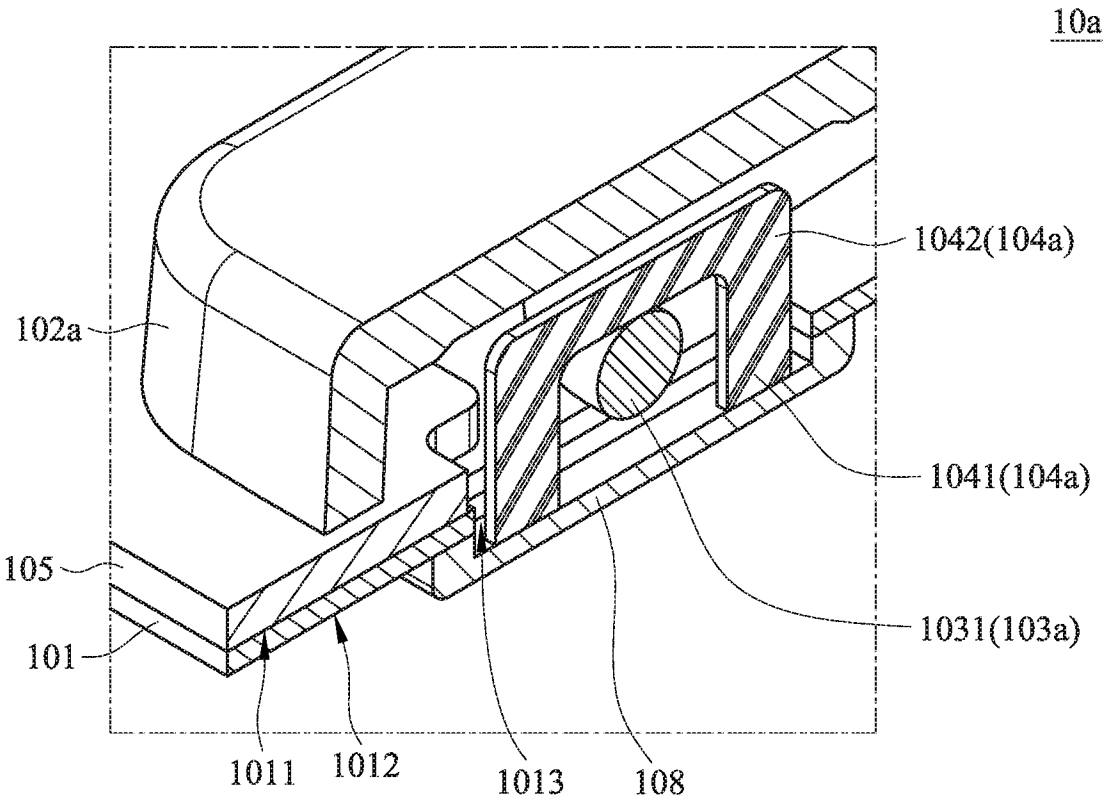
FIG. 6 is a schematic cutaway view illustrating a portion of a key structure according to another embodiment of the present invention.

FIG. 6 is a schematic cutaway view illustrating a portion of a key structure according to another embodiment of the present invention. In comparison with the first embodiment as shown in FIGS. 2, 3, 4 and 5, the keycap 102*a* of the key structure 10*a* of this embodiment has the larger area and length. For example, the key structure 10*a* is a "Space" key, of the keyboard device 1 as shown in FIG. 1. Alternatively, the key structure 10*a* is an "Enter" key, a "Shift" key, a "Caps Lock" key or any other similar multiple key. Since the key structure 10*a* has the larger area and length, the connecting member 103 of the key structure 10*a* is further equipped with a stabilizer bar 1031 for providing stabilizing efficacy. The connecting member 103 of the key structure 10*a* is the combination of the stabilizer bar 1031 and a scissors-type connecting member (not shown). In an embodiment, the stabilizer bar 1031 is an elongated bar, which is installed under the keycap 102*a* and arranged around the periphery of the scissors-type connecting member. For example, as shown in FIGS. 3, 4 and 5, the stabilizer bar 1031 is arranged around the periphery of the two frames 1030 of the scissors-type connecting member. While the keycap 102*a* is pressed down, the keycap 102*a* can be evenly moved downwardly because of the arrangement of the stabilizer bar 1031. That is, the keycap 102*a* is not aslant moved downwardly.

In this embodiment, the stabilizer bar 1031 is pivotally coupled to the hook element 104*a*. The hook element 104*a* comprises a hooking part 1042 and two positioning parts 1041. Moreover, the stabilizer bar 1031 has an inverted U-shaped profile. That is, the two positioning parts 1041 are protruded downwardly from the two lateral sides of the hooking part 1042, respectively. The two positioning parts 1041 are penetrated through the perforation 1013 of the supporting plate 101. Consequently, the hook element 104*a* is positioned on the two positioning parts 1041. Similarly, the supporting plate 101 is made of the material with the lower specific gravity, and the hook element 104*a* is made of the material with the higher specific gravity. The connecting relationships between the key structure 10*a* and other components are similar to the connecting relationships between the key structure 10 as shown in FIGS. 2, 3, 4 and 5 and other components, and not redundantly described herein.

From the above descriptions, the present invention provides the keyboard device and the key structure. In the key structure, the supporting plate is made of a first material, and the hook element installed on the supporting plate is made of a second material. The first material has a first specific gravity. The second material has a second specific gravity. The second specific gravity of the second material is higher than the first specific gravity of the first material. Since the supporting plate is made of the material with the lower specific gravity, the overall weight of the keyboard device is largely reduced, and the weight reduction purpose is achieved. Moreover, since the hook element installed on the supporting plate is made of the material with the higher specific gravity, the structural strength of the hook element is largely increased. While the connecting member (e.g., the scissors-type connecting member) is assembled with the supporting plate through the hook element, the possibility of causing damage of the hook element can be effectively avoided.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A keyboard device comprising plural key structures, wherein each key structure comprises: a membrane circuit board; a supporting plate comprising a perforation through the supporting plate; a keycap located over the supporting plate, and movable upwardly or downwardly relative to the supporting plate; a connecting member connected between the supporting plate and the keycap; and a hook element installed on the supporting plate, wherein the connecting member is connected with the supporting plate through the hook element, wherein the hook element comprises a positioning part penetrated through the perforation of the supporting plate; and a fixing structure covering a portion of a bottom surface of the supporting plate, wherein a maximum distance between the positioning part and a side surface of the perforation is less than an overlapping width between the fixing structure and the supporting plate, wherein the supporting plate is made of a first material with a first specific gravity, and the hook element is made of a second material with a second specific gravity, wherein the second specific gravity is higher than the first specific gravity; wherein each key structure further comprises a backlight module, wherein the backlight module is located under the supporting plate, and the supporting plate is arranged between the membrane circuit board and the backlight module, the backlight module having an opening, wherein the fixing structure is accommodated within the opening of the backlight module.

2. The keyboard device according to claim 1, wherein the first specific gravity of the first material is in a range between 1.4 g/cm$^3$ and 1.9 g/cm$^3$.

3. The keyboard device according to claim 1, wherein the second specific gravity of the second material is in a range between 2.64 g/cm$^3$ and 7.93 g/cm$^3$.

4. The keyboard device according to claim 1, wherein the first material is CEM-1 single-sided glass fiber material, CEM-3 double-sided half glass fiber material, FR4 double-sided glass fiber material, magnesium lithium alloy or magnesium alloy material.

5. The keyboard device according to claim 1, wherein the second material is hot-dip galvanized steel material, aluminum alloy material or stainless steel material.

6. The keyboard device according to claim 1, wherein each key structure further comprises:

the membrane circuit board arranged between the keycap and the supporting plate; and an elastic element arranged between the membrane circuit board and the keycap.

7. The keyboard device according to claim 1, wherein the connecting member is a scissors-type connecting member, a stabilizer bar or a combination of the scissors-type connecting member and the stabilizer bar.

8. The keyboard device according to claim 1, wherein a portion of the positioning part is protruded outside the perforation.

9. The keyboard device according to claim 8, wherein the portion of the positioning part protruded outside the perforation is covered by the fixing structure, so that the hook element is fixed on the supporting plate through the fixing structure.

10. A key structure, comprising: a membrane circuit board; a supporting plate; a keycap located over the supporting plate, and movable upwardly or downwardly relative to the supporting plate; a connecting member connected between the supporting plate and the keycap; and a hook element installed on the supporting plate, wherein the connecting member is connected with the supporting plate through the hook element, of the supporting plate; and a fixing structure covering a portion of a bottom surface of the supporting plate, wherein a maximum distance between the positioning part and a side surface of the perforation is less than an overlapping width between the fixing structure and the supporting plate wherein the supporting plate is made of a first material with a first specific gravity, and the hook element is made of a second material with a second specific gravity, wherein the second specific gravity is higher than the first specific gravity; wherein each key structure further comprises a backlight module, wherein the backlight module is located under the supporting plate, and the supporting plate is arranged between the membrane circuit board and the backlight module, the backlight module having an opening, wherein the fixing structure is accommodated within the opening of the backlight module.

11. The key structure according to claim 10, wherein the supporting plate comprises at least two perforations, and the key structure comprises at least two hook elements substantially aligned with the at least two perforations, respectively.

12. The key structure according to claim 11, wherein a dimension of each of the at least two perforations is smaller than a dimension of each of the at least two fixing structures.

13. The key structure according to claim 10, wherein the fixing structure is a soldering material.

14. The key structure according to claim 10, wherein the second material is hot-dip galvanized steel material, aluminum alloy material or stainless steel material.

15. The key structure according to claim 10, wherein the fixing structure and the hook element are made of different materials.

* * * * *